US006455796B2

(12) United States Patent
Kashino

(10) Patent No.: US 6,455,796 B2
(45) Date of Patent: Sep. 24, 2002

(54) FILM INTEGRATED KEY TOP

(75) Inventor: Masayuki Kashino, Tokyo (JP)

(73) Assignee: Polymatech CP., Ltd. (JP)

( * ) Notice: Subject to any disclaimer, the term of this patent is extended or adjusted under 35 U.S.C. 154(b) by 0 days.

(21) Appl. No.: 09/812,914

(22) Filed: Mar. 20, 2001

(30) Foreign Application Priority Data

Mar. 28, 2000 (JP) ..... 2000-088673

(51) Int. Cl.[7] ..... H01H 13/70
(52) U.S. Cl. ..... 200/512; 200/5 A; 200/517
(58) Field of Search ..... 200/5 A, 511, 200/512, 517, 341, 343, 344, 345

(56) References Cited

U.S. PATENT DOCUMENTS 5,613,599 A * 3/1997 Inagaki et al. ..... 200/512
5,807,002 A * 9/1998 Tsai ..... 400/494
6,103,346 A * 8/2000 Nakajo et al. ..... 428/172
6,180,895 B1 * 1/2001 Hutchinson et al. ..... 200/5 A
6,180,896 B1 * 1/2001 Naritomi ..... 200/5 A

* cited by examiner

*Primary Examiner*—Michael Friedhofer
(74) *Attorney, Agent, or Firm*—McGlew and Tuttle, P.C.

(57) ABSTRACT

A film integrated key top made by linking a plurality of key tops with a resin film, wherein the resin film linking key tops is formed bending more downward than the lower end of a pasted section with the key top body, the miniaturized film integrated key top allowing to reduce key top interval, prevent adjacent key tops from working together, and present a fine appearance.

3 Claims, 4 Drawing Sheets

FILM INTEGRATED KEY TOP

BACKGROUND OF THE INVENTION

1. Technical Field of the Invention

The present invention concerns a film integrated key top of a press button switch mounted in the input section of phone, mobile communication equipment, audio equipment, television, video, facsimile, copy machine or on board equipment or the like.

2. Prior Arts

In recent years, according to minimization and mobilization of electric and electronic equipment, it is also required to miniaturize, and to reduce the thickness and weight of push-button switches used for their operation section.

To respond to this demand, conventionally, as shown in FIG. 5, it has been known a sheet shaped key top, wherein a key top body 4 is formed, by printing a predetermined character or symbol on the top or bottom surface of a flexible, transparent or semi-transparent resin film 5, bending this resin film upwards, and at the same time, directly heat fusing thermoplastic resin in the bend section, or adhering resin in the bent section of this resin film via an adhesive resin layer. When this conventional film integrated key top is mounted in an apparatus, respective key tops were provided individually in the frame of a case 10.

Problems to be Solved by the Invention

However, in the conventional film integrated key top, when a key top is pressed, adjacent key tops work together inconveniently. To avoid this problem, as shown in FIG. 4, a slot 11 is formed approximately at the middle of a resin film 5 between key tops, or as shown in FIG. 5, a slit 13 is provided on the resin film 5 between key tops.

However, these method certainly prevent key tops from working together, they could not reduce the key top interval, and contribute to the apparatus minimization.

Means to Solve the Problems

In order to solve the aforementioned problems, the present invention intends to provide a film integrated key top allowing to reduce key top interval, present a fine appearance, and contribute to the minimization.

In short, a film integrated key top is composed by bending a film linking key tops more downward than the lower end of a pasted section with the key top body.

DETAILED DESCRIPTION OF THE PREFERRED EMBODIMENTS

The present invention concerns a film integrated key top made by linking a plurality of key tops by a resin film, wherein the resin film linkage section between key tops is formed bending more downward than the lower end of pasted section with the key top body.

Now, the invention will be described in detail referring to attached drawings.

Embodiment 1

Figure 1:
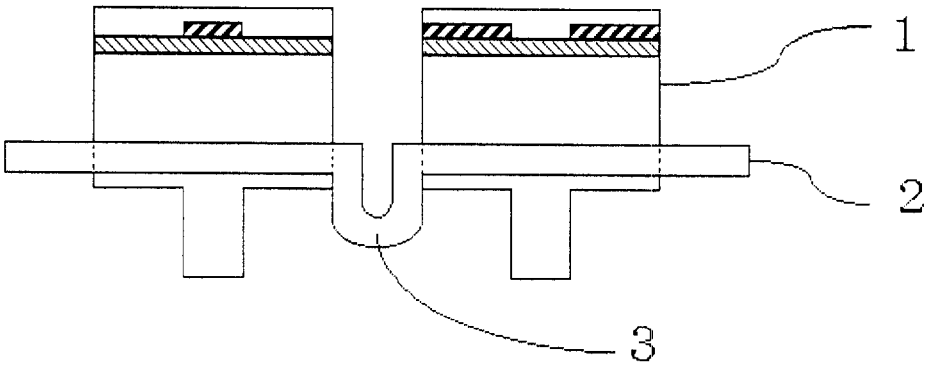
FIG. 1 shows a longitudinal cross section of an embodiment of the present invention.
Figure 2:
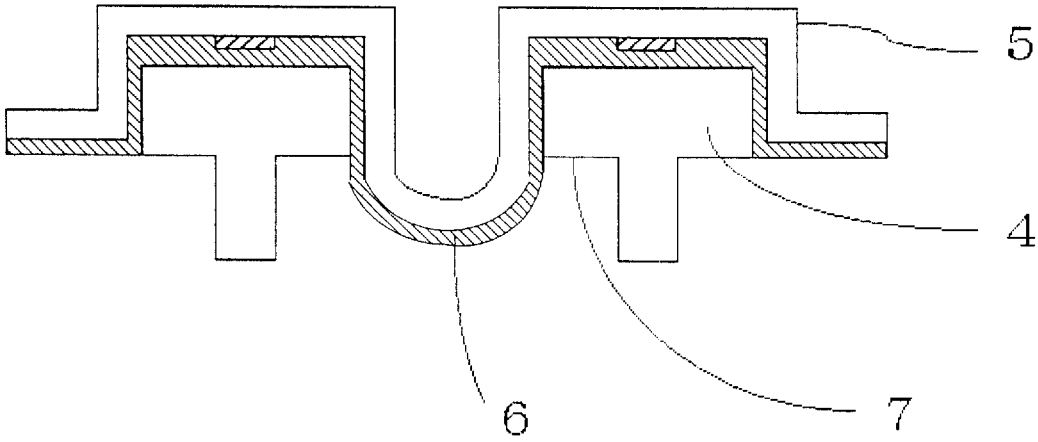
FIG. 2 shows a longitudinal cross section of an embodiment of the present invention.
Figure 3:
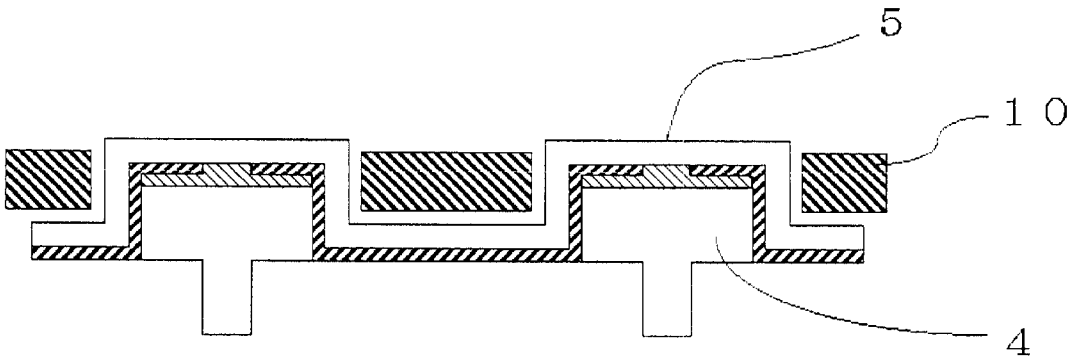
FIG. 3 PRIOR ART
FIG. 3 shows a longitudinal cross section of a conventional film integrated key top.
Figure 4:
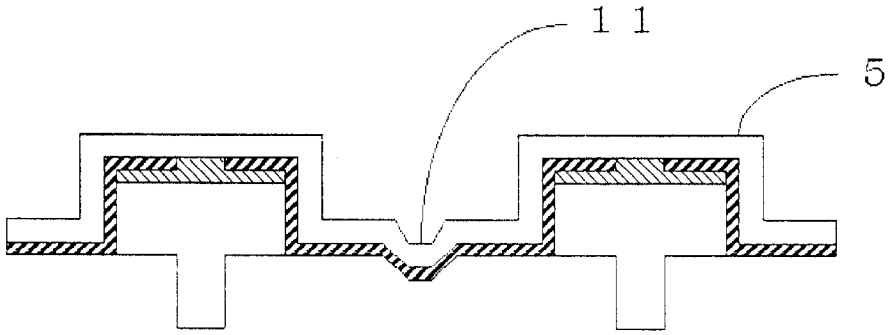
FIG. 4 PRIOR ART
FIG. 4 shows a longitudinal cross section of a conventional film integrated key top.
Figure 5:
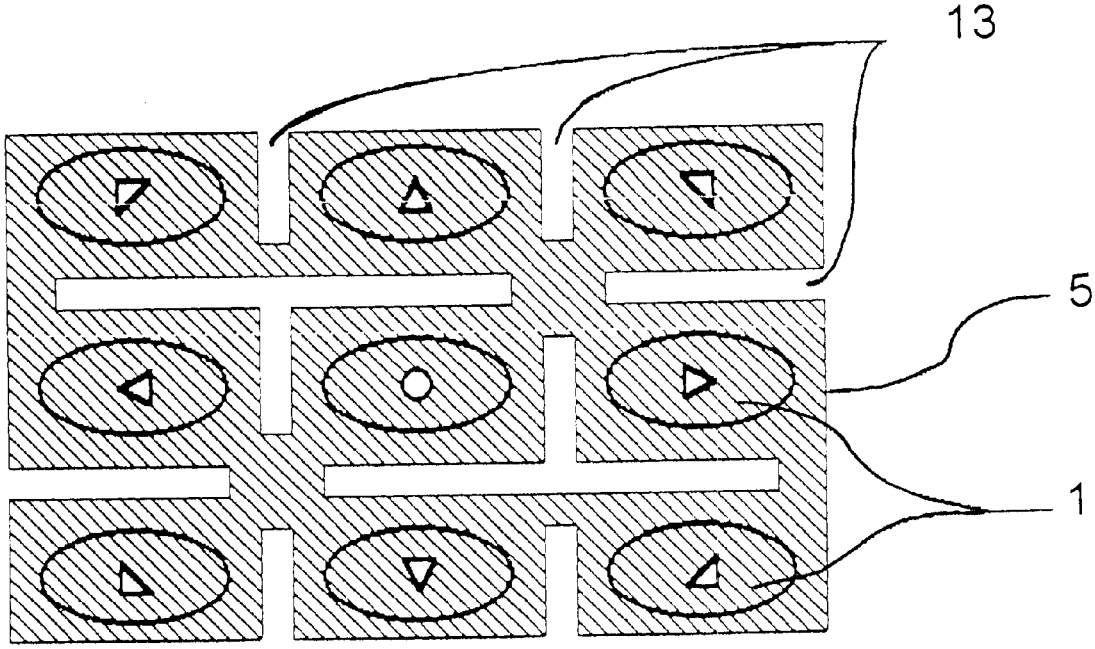
FIG.5 PRIOR ART
FIG. 5 shows a top view of the conventional film integrated key top.
Figure 6:
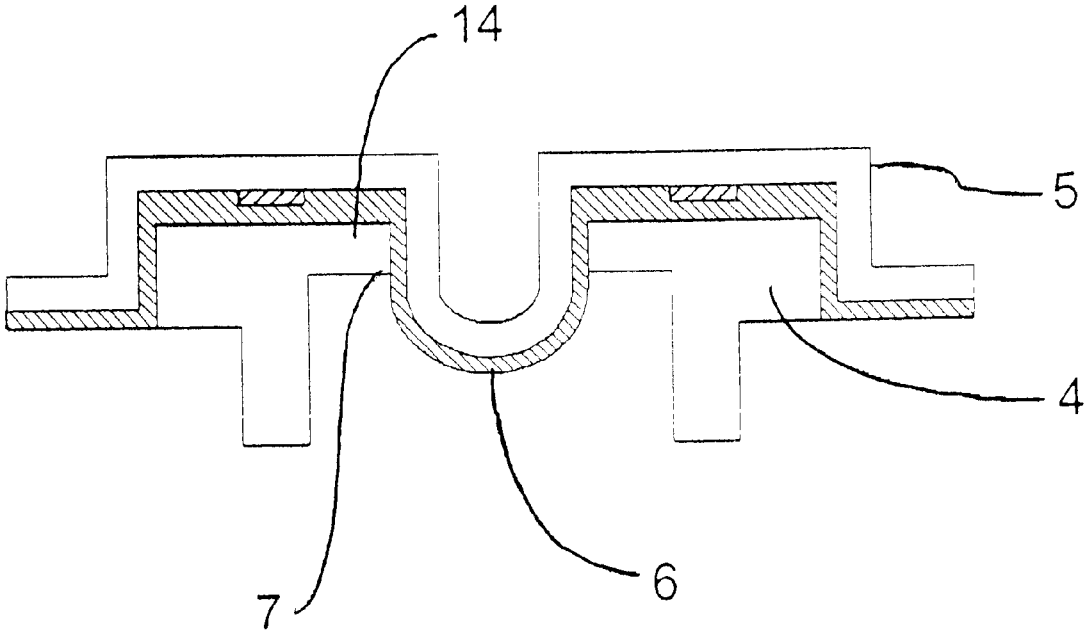
FIG. 6 shows a longitudinal cross section of an embodiment of the present invention.

The film integrated key top is believed to be applied to a key top body 1 passing through a film 2 as shown in FIG. 1, or a key top body 4 integrated at its top face side with a resin film 5 formed in a same shape as the key top body top face side.

Embodiment 2

Still another embodiment of the present invention is a film integrated key top, wherein a key top body 4 made of resin, and a resin film 5 formed in a same shape as the key top body top face side, at the top face side of the key top body, and wherein the resin thickness of the key top body is formed of a partial thin section 14, a resin film linkage section 6 between key tops is formed bent more downward than a lower end of a section pasted to the thin section 14 of the key top body.

Figure 7:
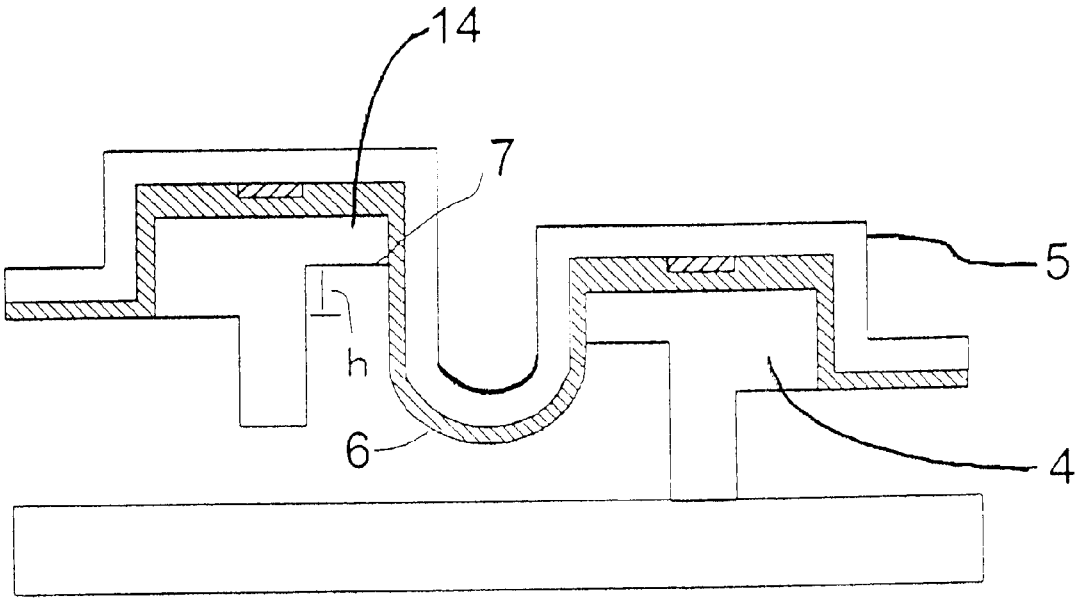
FIG. 7 shows a schematic diagram of switch operation.

The switch stroke length can be adjusted conveniently according to the height h notched for thinning, as described in the switch operation in FIG. 7, by forming the resin thickness of the side adjacent to the key top into a partially thinned portion.

The cross section shape of the linkage section formed in bent form of the present invention may be composed of curved portions only, or combination of curved portions and straight portions; however, the composition only by curved portions allows to reduced further the interval between key tops.

Effects of the Invention

The present invention provides a film integrated key top allowing to reduce key top interval, present a fine appearance, because, the resin film between key tops is formed bent downward. Adjacent key tops are prevented from working together, without cutting them respectively. A plurality of key tops can be disposed in a narrow space in the frame of the case.

In addition, as the interval between key tops is formed in a bent shape, the key top to its original position after being pressed. The die structure for molding the key top is also made simpler, the production can be increased, and the manufacturing cost can be reduced.

What is claimed is:

1. A plurality of film integrated key tops, comprising:

a first key top body having an upper side part and a lower side parts wherein said upper side part of said first key top body includes a partially thinned portion of said first key top body and a partially thick portion of said first key top body and said lower side forms a contact portion of said first key top body;

second key top body having an upper side part and a lower side part, wherein said upper side part of said second key top body includes a partially thinned portion of said second key top body and a partially thick portion of said second key top body and said lower side forms a contact portion of said second key top body;

a resin film linkage section connecting to said partial thin section of said first key top body with said partial thin section of said second key top body.

2. A plurality of film integrated key tops as claimed in claim 1, wherein the upper side of said first and said second key tops further comprises an upper face and a side face, said resin film is pasted to said upper face and said side face of the plurality of adjacent key top bodies.

3. A plurality of film integrated key tops as claimed in claim 1, wherein said resin film linkage section is formed extending below said partially thin portions of said first and said second key tops.

* * * * *